US005946839A

United States Patent [19]

Ödmark

[11] Patent Number: 5,946,839

[45] Date of Patent: Sep. 7, 1999

[54] ADAPTER FOR ATTACHING AN INFORMATION CARRIER TO A HOOK

[75] Inventor: Ola Ödmark, Uppsala, Sweden

[73] Assignee: Pricer Inc., Norwalk, Conn.

[21] Appl. No.: 08/836,095

[22] PCT Filed: Nov. 3, 1995

[86] PCT No.: PCT/SE95/01303

§ 371 Date: Apr. 29, 1997

§ 102(e) Date: Apr. 29, 1997

[87] PCT Pub. No.: WO96/14630

PCT Pub. Date: May 17, 1996

[30] Foreign Application Priority Data

Nov. 3, 1994 [SE] Sweden ..... 94 03775

[51] Int. Cl.[6] ..... G09F 3/00; B42F 1/00

[52] U.S. Cl. ..... 40/642.01; 24/3.6; 24/3.12; 211/57.1

[58] Field of Search ..... 40/642.01, 657, 40/655; 24/3.6, 616, 3.12; 211/57.1, 59.1; 248/215, 692

[56] References Cited

U.S. PATENT DOCUMENTS

| | | | |
|---|---|---|---|
| 5,088,606 | 2/1992 | Boas | 211/571 |
| 5,531,417 | 7/1996 | Valiulis et al. | 248/303 |
| 5,597,150 | 1/1997 | Stein et al. | 248/551 |
| 5,645,175 | 7/1997 | Wood | 211/57.1 |
| 5,718,340 | 2/1998 | Nagel | 211/57.1 |

*Primary Examiner*—Cassandra H. Davis
*Attorney, Agent, or Firm*—Young & Thompson

[57] ABSTRACT

An attachment member is provided for suspending an information carrier at the outer end of a unit-packaging holder. The attachment member includes a flexible bracket (8) having a pin member (9, 11) formed in both ends thereof for permanently fixing in a recess (6) provided for this purpose in the information carrier (1). The attachment member includes a bulge (12) provided on the inside of the bracket, the cross-sectional size of the bulge being adapted to the spacing between the legs of the holder in order to permit the bracket and information carrier, in a first receiving position, to hang swing freely from the holder and, in a second receiving position, releasably fix the attachment member and the information carrier with the holder legs in clamping connection with the bulge and in axial alignment with the holder.

6 Claims, 4 Drawing Sheets

ADAPTER FOR ATTACHING AN INFORMATION CARRIER TO A HOOK

TECHNICAL FIELD

The present invention relates to an attachment means, by means of which an information carrier is suspended at the outer end of a mounting holder or article-displaying bracket provided for unit packagings, a preferred embodiment of the invention aiming at providing an attachment means, by means of which a photo-electrically powered price-marking device is adapted to be suspended from the article-displaying bracket.

BACKGROUND ART

Price-marking devices or price tags of this type are increasingly used in stores, e.g. to display the unit price, the whole sale price, the regular price and the occasional price of an article, etc. When provided, these price tags are powered by means of a photo-electrical cell and exhibit a price-indicating window and are provided with at least one sensor means for remote-controlling the price window and for interactive communication between individual price tags. Such price tags are well-known, and since the invention is focused on an attachment means, by means of which the price tag or any information carrier is adapted so as to be utilized to indicate the price of an article, the package of which is constructed to be suspended on a mounting holder for displaying articles, no detailed description of the internal structure and function of the price tag will be given herein.

Usually, these price tags are designed to be attached either on a shelf edge to indicate the price of an article on display on said shelf, or at the end of a rod to display the price of bulk weight articles, such as fruit etc.

Another common type of article display comprises various types of unit packagings, such as a plastic cover, which secures the article onto a backing cardboard, a so-called "blisterpack", said cardboard exhibiting at its top portion an elongated, horizontal perforation for suspension on a mounting holder for storage and display. Thereby, the perforation is designed to be suspendable as desired from a mounting holder shaped into a bracket, or from a simple wire rod, said perforation to this end being provided with a centrally located, semi-circular recess in the upper defining edge thereof. Another type of package interacting with a similar mounting holder comprises, for instance, bags having a folded-over cardboard secured through staples to the mouth of the bag in order to close the bag. The cardboard component is thereby provided with an elongated hole of the type mentioned for sending the bag on the holder.

The bracket-shaped mounting holder is in the form of an elongated bracket, wherein the two parallelly extending legs are interconnected by a transverse, possibly arcuate section at the outer end, said outer end being slightly bent upwards in some cases, and the inner ends of the legs are shaped to, for instance, engage with a perforated rail and to secure the bracket in an essentially horizontal orientation. The wire bracket is bent-shaped from a single element.

The displaying type referred to above it used internationally, and there is a certain standard with respect to the dimensions of the mounting holder and the perforation, see e.g. DS 903 (Danish standard), SS 847009 (Swedish standard) and DIN 55 612 Teil 1-1977 (German standard). The term "Eurohole" will thus be found in the art with reference to said standardized perforation. It should be noted, that there are at least two sizes of perforations and related article-displaying brackets, said invention being intended to cooperate with the larger bracket. It is however appreciated that the inventive idea will also be implementable with respect to the smaller size by adjustment of the exterior dimensions.

Since the display of unit packagings suspended from wire brackets is usually quite dense, in many cases there will not be enough space for attaching a price tag of said type to the mounting rail of the wire bracket.

DISCLOSURE OF THE INVENTION

According to the invention, this problem is solved by designing an attachment means and a price tag so as to be suspendable at the tip of the article-displaying bracket.

It must be emphasized that the attachment means also may be used in combination with any other kind of information carrier, e.g. signs carrying printed information about the article, such as price, field of application, declaration of contents etc. The invention will however be described in relation to the context of use mentioned above.

Thus, the primary object of the invention is to disclose an attachment means, by means of which an information carrier is suspendable from the outer end of a mounting holder or article-displaying bracket.

A second object is to disclose a photo-electrically powered price tag having attachment means for cooperating with an article-displaying bracket.

The first object will be met by an attachment means in accordance with the appended patent claim 1, and the second object by a price tag in accordance with the appended patent claim 3.

BRIEF DESCRIPTION OF THE DRAWINGS

The invention will be described more in detail with reference to the appended drawings, wherein.

MODE FOR CARRYING OUT THE INVENTION

Figure 1A:
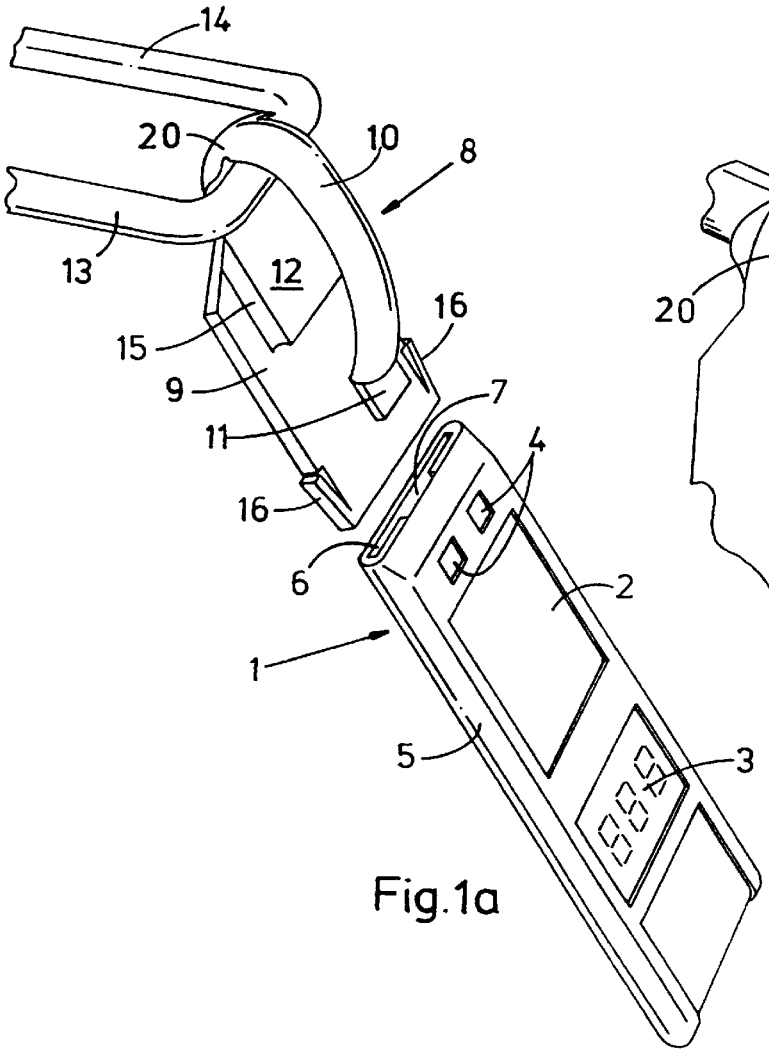
FIG. 1*a* and 1*b* show perspective views of an exemplary embodiment of the information carrier/price tag and the attachment means in a position prior to mounting onto an article-displaying bracket or wire bracket.

Referring to FIG. 1*a*, an information carrier is shown, generally referred to by the numeral 1, which information carrier e.g. may constitute a price tag 1. In a body 5, the information carrier or price tag 1 is provided with a photoelectrical cell 2 for the power supply thereof, a price window 3, and a pair of sensor means 4 for the reception of control signals to the price window and for the interactive communication with other price tags. Since the invention is focused on the mechanical design of the information carrier/price tag attachment means for cooperating with an article-displaying bracket, a detailed description of the well-known function and the internal structure of the price tag will be omitted herein.

Figure 2:
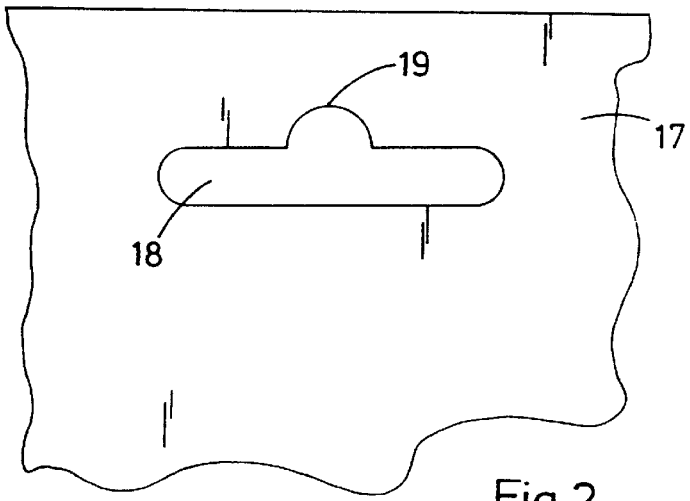
FIG. 2 shows an enlarged front view of a standard perforation, a so-called "Eurohole""

The price tag 1 has a cross-sectional dimension, which is adapted to a so-called "Eurohole" and which enables the price tag to be inserted therethrough, said "Eurohole" being the perforation 18 of a unit packaging 17, which perforation cooperates with the article-displaying bracket (see FIG. 2). To this end, the price tag 1 of the illustrated embodiment has a width less than 30 mm and a thickness of appr. 3.5–4.5 mm, the longitudinal edges thereof preferably being rounded or the longitudinal sides thereof being e.g. semi-circular. In the disclosed size, the dimensions of the perforation have a horizontal length of 30 mm with a 2.5 mm radius at the ends of the perforation, a width of 5 mm, and the semi-circular recess 19 in the upper defining edge of the perforation has a radius of 5 mm.

At one of its two ends, the upper one when oriented for use, the price tag 1 is provided with a recess 6 having a preferably rectangular cross section, which extends along a substantial portion of the body width. A groove 7 may be provided in one of the two limiting surfaces of the recess, and the respective axial length of the recess and the groove is adapted to receive the attachment means in a manner that will be described more closely hereinafter.

The attachment means, generally designated by the numeral 8 in FIG. 1*a* and forming a flexible bracket 8 as a whole, is provided with an essentially rectangular, relatively thin bottom portion or plate 9, from the one end of which a bracket 10 extends, which is essentially arcuate and extends with its free end across the top side of the plate. The free end of the bracket is suitably shaped into a pin 11, the cross-sectional shape of which, when desired, is adapted to the groove 7 in order to be received and fixed therein in the mounted condition.

At its top side, the bottom portion or plate 9 is provided with a bulge or boss 12, which according to the exemplary embodiment may be an extension of the bracket 10 and extends from the transition thereof into the plate 9 and a distance away from this. The boss 12 has a height and thickness, which is adapted to the distance between the parallelly extending legs 13, 14 of the bracket, and are provided with concave lateral faces 15 for clamp-fixing the attachment means between the legs, when the attachment means is axially aligned with the wire bracket, as shown in FIG. 3.

Upon mounting of the attachment means 8 and the price tag 1, the bracket 10 is placed around the transverse section between the legs in the tip of the wire bracket, after which the plate 9 of the attachment means and the free end 11 of the bracket, respectively, are inserted and fixed within the recess 6 and the groove 7 in the price tag. In order to permanently lock the two components to each other, the plate 9 is provided with locking elements, such as in the form of hooks, serrations or, as in the embodiment, resilient tongues 16 engaging, in a well-known manner, matching elements or shoulders (not shown) on the inner side of the recess 6.

Figure 3:
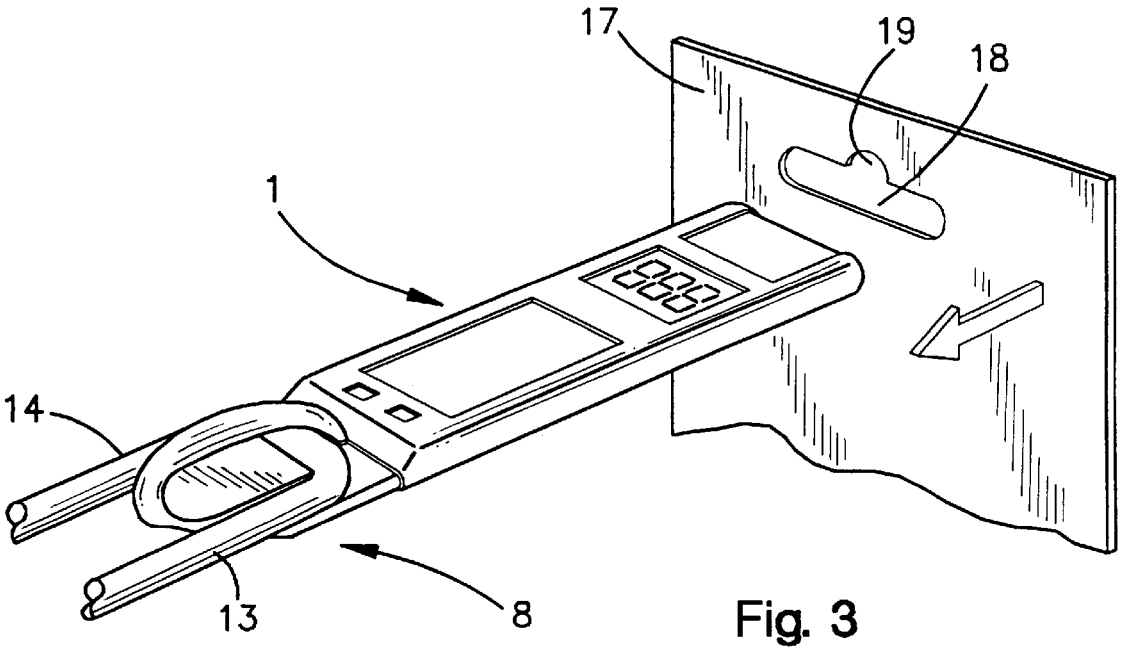
FIG. 3 shows a perspective view of the mounted price tag and the attachment means in an article resupply position.

FIG. 3 shows a position for re-supplying packages to an article-displaying bracket having the price tag of the invention suspended on the tip of the bracket. Having the boss 12 firmly gripped between the bracket legs, the attachment means and the price tag mounted thereon extend along the extension of the article-displaying bracket, whereby packages 17 having a perforation thus are easy to push past the price tag and the attachment means, so as to be stored on the article-displaying bracket. The bracket 10 of the attachment means thereby passes through the semi-circular recess 19 in the upper defining edge of the perforation. When the re-supplying is completed, the price tag will be releasable through a manual movement from its engagement with the legs of the article-displaying bracket, so as to depend vertically from the tip of the bracket.

Figure 4:
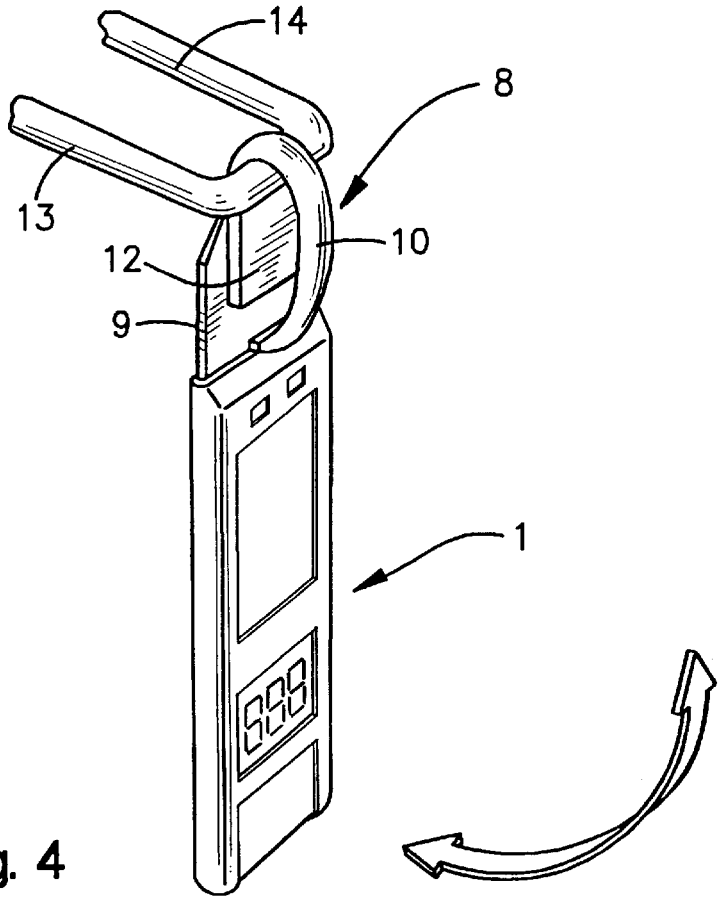
FIG. 4 shows a perspective view corresponding to FIG. 3 and illustrating the invention in a position, in which an article is removable from the wire bracket.

As a package is removed from the article-displaying bracket, the price tag will swing forward sliding through the perforation, swinging back as the package releases its grip to depend vertically in the bracket in accordance with the double arrow A of FIG. 4.

Figure 1B:
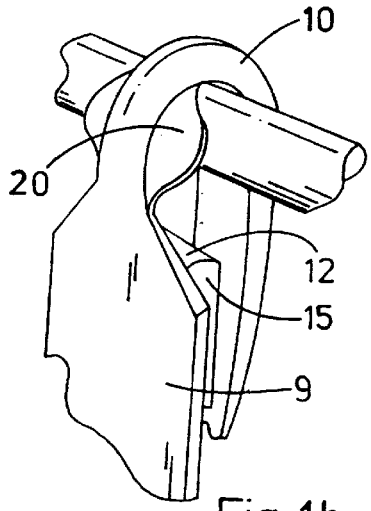

The bracket 10, as well as the attachment means as a whole, are suitably fabricated from a synthetic material, e.g. polyamide, polypropylene or plasticized polystyrene. The bracket preferably has a semi-circular or arcuate cross section along the major portion of its extension, but it may have a thinner cross section in the region of its smallest radius and may exhibit a shield portion 20, prior to connection to the plate, in order to provide enhanced lateral stability in the depending position of the price tag, as indicated in FIG. 1*b*.

Figure 5:
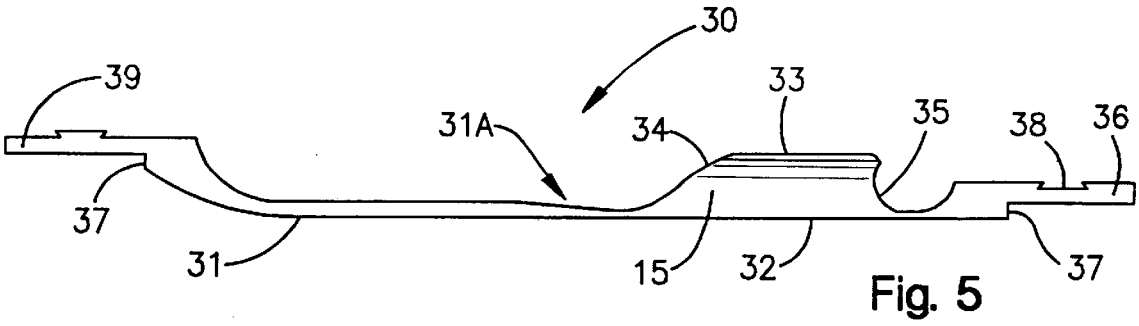
FIG. 5 shows a preferred embodiment of the attachment means in an unfolded position, prior to assembly around the transverse tip section of the wire bracket.

FIGS. 5–9 show an enlarged, preferred embodiment of the attachment means, FIG. 5 as a side elevational view showing the attachment means/bracket 31 in an extended position.

Figure 10:
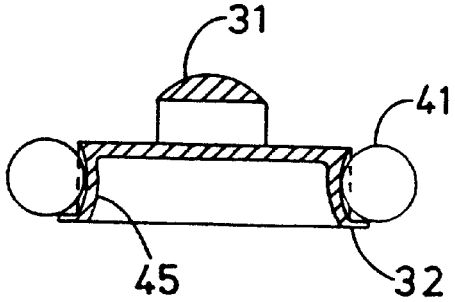
FIG. 10 shows an alternative embodiment of the attachment means in a cross-section corresponding to FIG. 9.

From FIG. 5, it will be appreciated that the attachment means bracket 30, which has an arcuate cross section or rounded lateral faces, gets thinner in the region 31A, so as to merge into the relatively thin bottom portion/plate 32. The bulge/boss 33 extends on the top side of the plate, the side faces of which bulge are concavely shaped or trough-shaped, as shown in the sectionalized view of FIG. 9. The boss 33 advantageously has an arcuate sliding surface 34 to facilitate pushing onto the article-displaying bracket in re-supplying of packages. The front edge of the boss may also have a trough-shape to offer an engagement position 35 to the transverse section of the wire bracket, as the attachment means is clamped between the legs of the article-displaying bracket. In an alternative embodiment, see FIG. 10, the boss may also be hollowed out at its bottom face, the side faces thereby forming resilient walls 45, which releasably fix the attachment means between the legs of the article-displaying bracket under elastic deformation.

In its frontal and, according to the drawing figure, right end, the bottom portion or plate is formed as a substantially rectangular pin component 36, possibly having a shoulder surface 37 for abutment against the cooperating price tag and preferably having a snap-locking element 38, such as a dovetail slot 38 for snap-locking in a well-known manner onto the matching pin component 39 of the bracket to the left in the drawing figure, so that the attachment means 30 self-lockingly and non-releasably is fixed to form the shape of a closed loop, which loop may only be opened upon destruction by use of a tool.

Figure 6:
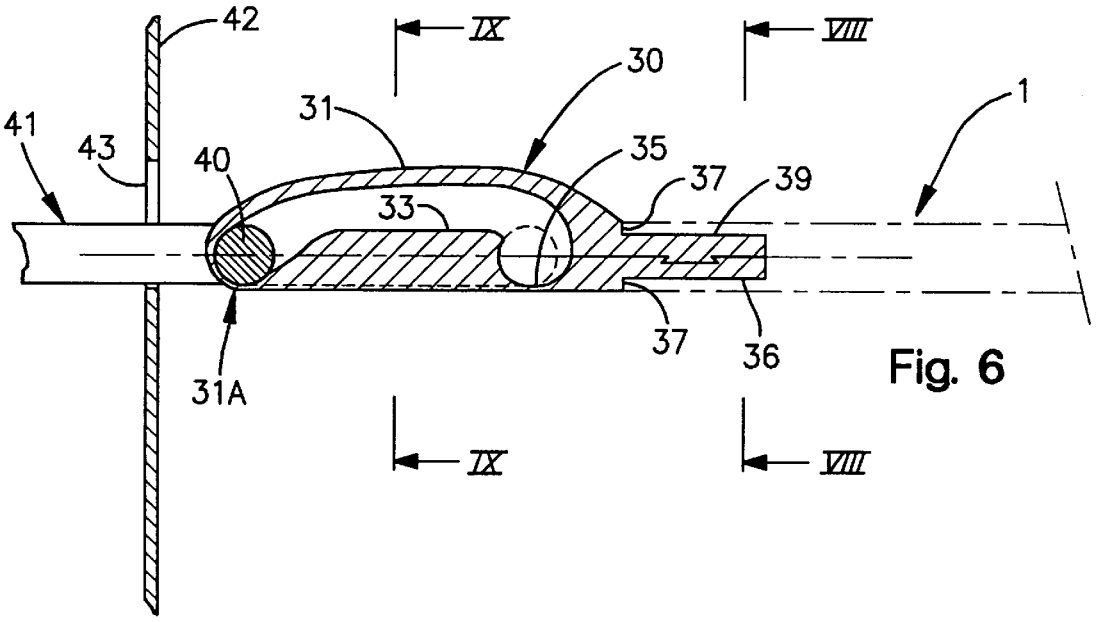
FIG. 6 shows a longitudinal cross-section of the attachment means of FIG. 5, as mounted on the wire bracket.

It will be appreciated that the material thickness of the thinnest portions of the attachment means at 31A and at 35 has to be adapted to the clearance existing between the legs of the article-displaying bracket and the perforation in the package, and may thus have a size in the order of one half tenth to a few tenths of a millimeter. Accordingly, the material is required to demonstrate a high tensile strength, yet it has to be flexible, when the region 31A is bent around the bridging, transverse section of the legs, as shown in FIG. 6. It is proposed herein, that the attachment means in its entirety be fabricated from a synthetic material, e.g. polyamide, polypropylene or plasticized polystyrene, but it will be left for a skilled person to compose the material in detail in order to attain an optimum mechanical strength. It will also be conceivable to produce the attachment means from a metal, such as spring steel.

Figure 8:
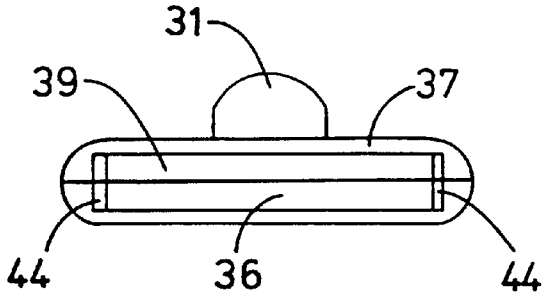
FIG. 8 shows an end view of the attachment means of FIG. 6 in the direction of the arrow VIII.
Figure 9:
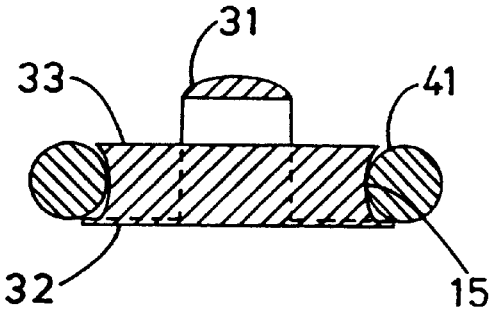
FIG. 9 shows a cross-section of the attachment means taken along line IX—IX of FIG. 6.

It will also be appreciated that the cross-sectional shape obviously will be adapted to the shape and dimension of the perforation of the package, as shown in the end view of FIG. 8.

Figure 7:
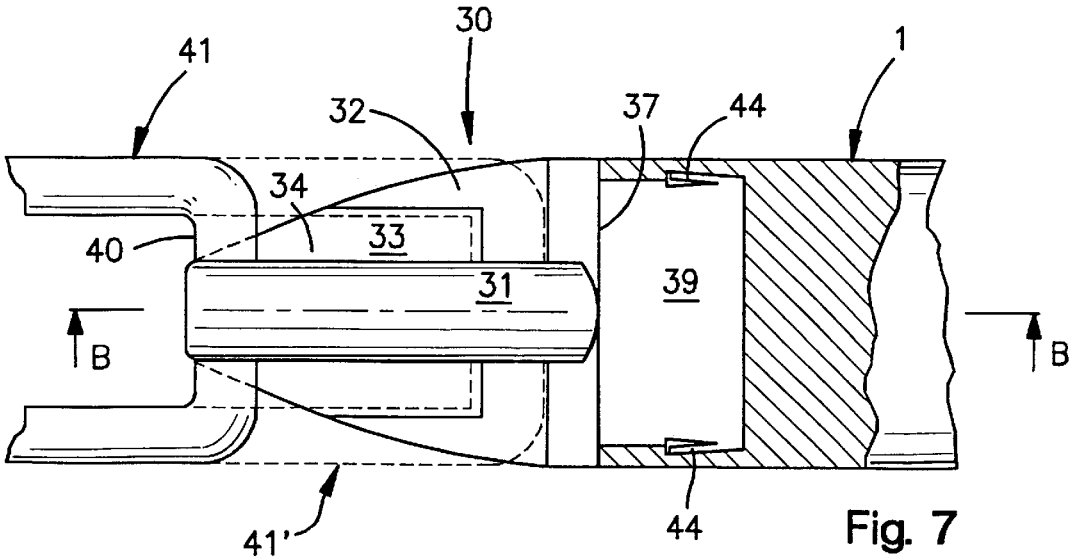
FIG. 7 shows the attachment means of FIGS. 5 and 6 in a view from above.

Referring to FIG. 6, a longitudinal section through the attachment means taken along the line B—B of FIG. 7 is shown, the bracket 31 being folded around the transverse section 40 of the article-displaying bracket 40, which section is pivotally journalled in the bent-over portion of the bracket in the region 31A. Thereby, the pin component 39 is firmly connected to the pin component 36 through snap-locking action in the slot 38, and is shown as being inserted in the recess of a schematically illustrated price tag 1 in phantom lines. A broken-away portion of the back face 42 of a unit packaging is shown as threaded onto the article-displaying bracket 41, said perforation being shown with its centrally located semicircular recess at 43.

FIG. 7 shows a plan view from above of the attachment means 30, mounted in a partially broken-away price tag 1 and attached to the tip of the wire bracket 41. A dash line illustrates the way the wire bracket in a position 41' for the threading of packages rests in the space 35 and releasably fixes the attachment means and thus the price tag 1 in axial alignment with the wire bracket or article-displaying bracket through clamping engagement with the side faces of the boss 33. The boss is disengaged from the legs of the wire bracket by pushing the bracket 31 down, after which the attachment means and the price tag are manually pushed to the right in the figure, so that the tip 40 of the wire bracket will slide between the flexible bracket and the top face of the boss, thus being forced again to rest in the bent-over portion 31A of the bracket. The figure further schematically shows the way each locking element 44 of the pin 39, designed as elastic tongues 44, engages a wedge-shaped space in the recess of the price tag for permanently fixing the attachment means 30 in the price tag 1. It will be realized that the pin component 36 of the bottom portion, too, may be provided with locking elements, such as hooks, serrations, tongues or similar means.

Figure 11:
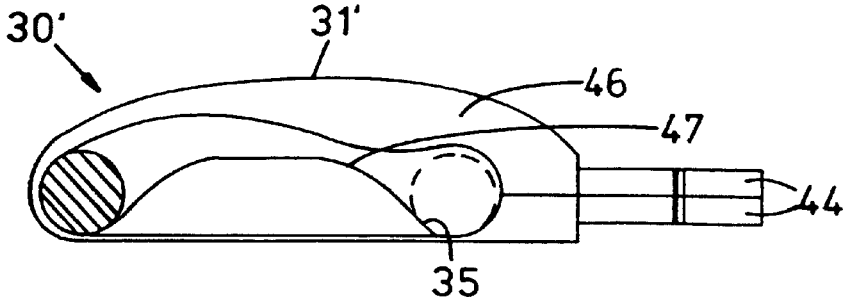
FIG. 11 shows an alternative embodiment of the attachment means in a side view.

FIG. 11 shows an alternative embodiment of the attachment means 30', wherein the bracket 31' has a bulge 46 in its bottom face and the boss 33' has a rounded front edge 47. Thereby, a smoother movement and snap-locking of the mounting holder in the space 35 will be achieved, while maintaining a well defined resting position of the transverse section of the holder. At the same time, the shape permanence of the bracket will be enhanced and its operation during depressing of the boss from the clamp connection with the holder legs will be improved.

Although the invention has been described with reference to a specific user condition, it will be appreciated, as mentioned earlier that the attachment means as such will also be applicable in combination with an information carrier of another type than the electronic price tag illustrated in the drawings. It should thus be an easy task for a person skilled in the art to design any information carrier for reception of the attachment means in a recess in a similar manner with respect to the price tag mentioned above.

I claim:

1. An attachment member structured and arranged for suspending an information carrier at an outer end of a unit-packaging holder formed by first and second essentially parallel extending legs joined by a transverse section at an outer end of each leg, said attachment member comprising, a flexible bracket disposed in a folded position and including an elongated length forming a loop, said flexible bracket being structured and arranged so that said elongated length may be mounted around said transverse section with said transverse section extending through said loop, a free end of said flexible bracket structured and arranged to be fixed to said information carrier, a bulge extending into said loop, said bulge being structured and arranged to be clamped between said first and second legs of said unit-packaging holder, said flexible bracket having a first receiving portion within said loop adjacent a first end of said bulge and a second receiving portion within said loop adjacent a second end of said bulge, said elongated length being sufficiently flexible to permit passage within said loop of said transverse section between said first portion and said second portion, said flexible bracket being adapted to hang in a first direction from said transverse section at said first portion in a first mode and to extend in a second direction from said transverse section at said second portion, with said bulge clamped between said first and second leg in a second mode.

2. The attachment member of claim 1 wherein said free end is structured and arranged to be non-releasably fixed to said information carrier, said free end including a snap-in locking member structured and arranged to mate with a matching snap-locking member of said information carrier.

3. The attachment member of claim 1 including a first and a second snap-in locking member at a first and a second end, respectively, of said elongated length, said first and second snap-in locking member being engaged to form said loop.

4. The attachment member of claim 1 including a first surface and an opposite second surface, said first surface having a first end which includes a first pin and an opposite second end which includes a second pin, said bulge being disposed between said first pin and said second pin and extending from said opposite second surface, said bulge having a height and width which are structured and arranged to permit said bulge to be clamped between said first and second legs, opposite sides of said bulge including surfaces adapted to conform to said first and second legs, said first and second pins being engagable with each other to form said free end.

5. The attachment member of claim 1 further including an information carrier comprising (a) an end portion having a recess, said free end extending into said recess to fix said information carrier to said flexible bracket; (b) a window for displaying a price of an article; and (c) a sensor for remote controlling of said window.

6. An attachment member assembly comprising an attachment member, an information carrier and a unit-packaging holder, said attachment member suspending said information carrier at an outer end of said unit-packaging holder, said unit packaging holder comprising first and second essentially parallel extending legs joined by a transverse section at an outer end of each leg, said attachment member comprising, a flexible bracket disposed in a folded position and including an elongated length forming a loop, said elongated length being mounted around said transverse section with said transverse section extending through said loop, a free end of said flexible bracket attached to said information carrier, a bulge extending into said loop, said flexible bracket having a first receiving portion within said loop adjacent a first end of said bulge and a second receiving portion within said loop adjacent a second end of said bulge, said elongated length being sufficiently flexible to permit passage within said loop of said transverse section between said first portion and said second portion, said flexible bracket being adapted to hang in a first direction from said transverse section at said first portion in a first mode and to extend in a second direction from said transverse section at said second portion, with said bulge clamped between said first and second legs, in a second mode.

* * * * *